US007495562B2

(12) United States Patent
Monroe

(10) Patent No.: US 7,495,562 B2
(45) Date of Patent: Feb. 24, 2009

(54) NETWORKED PERSONAL SECURITY SYSTEM

(76) Inventor: David A Monroe, 720 Lincoln Center, 7800 IH-10 West, San Antonio, TX (US) 78230

( * ) Notice: Subject to any disclaimer, the term of this patent is extended or adjusted under 35 U.S.C. 154(b) by 40 days.

(21) Appl. No.: 11/617,438

(22) Filed: Dec. 28, 2006

(65) Prior Publication Data

US 2007/0164872 A1 Jul. 19, 2007

Related U.S. Application Data

(63) Continuation of application No. 11/057,264, filed on Feb. 14, 2005, now abandoned, and a continuation of application No. 09/974,337, filed on Oct. 10, 2001, now Pat. No. 6,853,302.

(51) Int. Cl.
*G08B 13/14* (2006.01)

(52) U.S. Cl. ..... 340/572.1; 340/572.4; 340/572.8; 340/573.1; 340/573.4; 340/539.12; 340/693.1; 340/825.49; 701/213; 701/214

(58) Field of Classification Search ..... 340/572.1, 340/572.4, 572.8, 573.1, 573.4, 539.12, 693, 340/825.49, 825.54; 701/213, 214
See application file for complete search history.

(56) References Cited

U.S. PATENT DOCUMENTS

| | | | |
|---|---|---|---|
| 4,163,283 | A | 7/1979 | Darby |
| 4,179,695 | A | 12/1979 | Levine et al. |
| 4,197,526 | A | 4/1980 | Levine |
| 4,516,125 | A | 5/1985 | Schwab et al. |
| 4,831,438 | A | 5/1989 | Bellman, Jr. et al. |

(Continued)

FOREIGN PATENT DOCUMENTS

| | | |
|---|---|---|
| EP | 220752 | 5/1987 |

(Continued)

OTHER PUBLICATIONS

Apr. 1966, Apollo Unified S-Band System, NASA-Goddard Space Flight Center, Greenbelt, Maryland.

(Continued)

*Primary Examiner*—Tai T Nguyen

(57) ABSTRACT

A personal alarm system can be worn or carried by the user, may be activated at any time by the user and/or may be automatically activated to send a signal to any remote monitoring station on the network. The device identifies the user as well as the user's location within the monitored area. The alarm-sending unit is designed to fit within a box the size of a small cell phone or pager. The unit includes an ID memory for identifying the user, is programmable and has an on-board processor for generating a signal to a wireless transmitter for sending the signal to a to a local receiver for inputting the signal onto the network. A centralized, networked RF receiver is used with the personal alarm unit and one or more of these RF receivers may be installed in order to provided adequate coverage of the monitored area. The signals generated by the personal alarm are received by the RF receiver(s) and decoded, whereupon the system processor assembles a message, packetizes it as necessary, and sends it to one or more monitoring stations via the intervening network and network interface. The signals may be digitized where desired. A beacon generator may be used to identify location of the portable unit. The system may also employ a GPS generator to identify location.

20 Claims, 15 Drawing Sheets

U.S. PATENT DOCUMENTS 4,845,629 A 7/1989 Murga
4,857,912 A 8/1989 Everett, Jr. et al.
4,891,650 A 1/1990 Sheffer
4,910,692 A 3/1990 Outram
5,027,104 A 6/1991 Reid
5,027,114 A 6/1991 Kawashime et al.
5,091,780 A 2/1992 Pomerleau
5,111,291 A 5/1992 Erickson
5,166,746 A 11/1992 Sato et al.
5,218,367 A 6/1993 Sheffer et al.
5,243,340 A 9/1993 Norman et al.
5,243,530 A 9/1993 Stanifer et al.
5,268,698 A 12/1993 Smith, Sr. et al.
5,283,643 A 2/1994 Fujimoto
5,321,615 A 6/1994 Frisbie et al.
5,334,982 A 8/1994 Owen
5,351,194 A 9/1994 Ross et al.
5,400,031 A 3/1995 Fitts
5,408,330 A 4/1995 Squicciarini et al.
5,432,838 A 7/1995 Purchase
5,440,337 A 8/1995 Henderson et al.
5,440,343 A 8/1995 Parulski
5,448,243 A 9/1995 Bethke et al.
5,463,595 A 10/1995 Rodhall et al.
5,469,371 A 11/1995 Bess
5,497,149 A 3/1996 Fast
5,508,736 A 4/1996 Cooper
5,530,440 A 6/1996 Danzer et al.
5,553,609 A 9/1996 Chen et al.
5,557,254 A 9/1996 Johnson et al.
5,557,278 A 9/1996 Piccirillo et al.
5,598,167 A 1/1997 Zjderhand
5,612,668 A 3/1997 Scott
5,627,753 A 5/1997 Brankin et al.
5,629,691 A 5/1997 Jain
5,636,122 A 6/1997 Shah et al.
5,640,144 A * 6/1997 Russo et al. ..... 340/568.1
5,642,285 A 6/1997 Woo
5,666,157 A 9/1997 Avid
5,670,961 A 9/1997 Tomote et al.
5,677,979 A 10/1997 Squicciarini
5,689,442 A 11/1997 Swanson
5,712,679 A 1/1998 Coles
5,712,899 A 1/1998 Pace, II
5,714,948 A 2/1998 Farmakis et al.
5,742,233 A * 4/1998 Hoffman et al. ..... 340/573.1
5,742,336 A 4/1998 Lee
5,748,147 A * 5/1998 Bickley et al. ..... 342/457
5,751,346 A 5/1998 Dozler
5,777,551 A 7/1998 Hess
5,777,580 A 7/1998 Janky et al.
5,793,416 A 8/1998 Rostoker et al.
5,835,059 A 11/1998 Nadel et al.
5,850,180 A 12/1998 Hess
5,867,804 A 2/1999 Pilley et al.
5,905,461 A * 5/1999 Neher ..... 342/357.07
5,917,405 A 6/1999 Joso
5,917,425 A * 6/1999 Crimmins et al. ..... 340/825.49
5,926,210 A 7/1999 Hackett et al.
5,933,098 A 8/1999 Haxton
5,938,706 A 8/1999 Feldman
5,974,158 A 10/1999 Auty et al.
5,983,161 A 11/1999 Lemelson et al.
5,999,116 A 12/1999 Evers
6,002,427 A 12/1999 Kipust
6,009,356 A 12/1999 Monroe
6,067,571 A 5/2000 Igarashi et al.
6,069,655 A 5/2000 Seeley
6,078,850 A 6/2000 Kane et al.
6,084,510 A 7/2000 Lemelson et al.
6,092,008 A 7/2000 Bateman
6,100,806 A * 8/2000 Gaukel ..... 340/573.4
6,100,964 A 8/2000 De Cremiers
6,133,941 A 10/2000 Ono
6,154,658 A 11/2000 Caci
6,157,317 A 12/2000 Walker
6,167,255 A * 12/2000 Kennedy et al. ..... 455/414.1
6,181,373 B1 1/2001 Coles
6,195,609 B1 2/2001 Pilley et al.
6,226,031 B1 5/2001 Barraciough et al.
6,246,320 B1 6/2001 Monroe
6,259,475 B1 7/2001 Ramachandran et al.
6,275,231 B1 8/2001 Obradovich
6,278,965 B1 8/2001 Glass et al.
6,282,488 B1 8/2001 Castor et al.
6,292,098 B1 9/2001 Ebata
6,356,625 B1 3/2002 Casteiani
6,385,772 B1 5/2002 Courtney
6,424,370 B1 7/2002 Courtney
6,462,697 B1 10/2002 Klamer et al.
6,476,858 B1 11/2002 Ramirez Diaz et al.
6,504,479 B1 1/2003 Lemons
6,522,532 B2 2/2003 Liao et al.
6,525,761 B2 2/2003 Sato et al.
6,549,130 B1 4/2003 Joso
6,556,241 B1 4/2003 Yoshimura et al.
6,570,610 B1 5/2003 Kipust
6,628,835 B1 9/2003 Brill
6,646,676 B1 11/2003 DaGrace
6,662,649 B1 12/2003 Knight et al.
6,675,386 B1 1/2004 Hendricks et al.
6,698,021 B1 2/2004 Amini
6,720,990 B1 4/2004 Walker et al.
7,113,971 B1 9/2006 Ohi et al.
2003/0071899 A1 4/2003 Joso
2005/0055727 A1 3/2005 Creamer et al.
2005/0138083 A1 6/2005 Rastegar

FOREIGN PATENT DOCUMENTS

EP 232031 8/1987
EP 532110 3/1993
EP 209397 7/1993
EP 613109 8/1994
EP 613110 8/1994
EP 744630 11/1996
EP 785536 7/1997
EP 613111 8/1998
JP 6-301898 10/1994
JP 9-282600 10/1997
JP HEI-10-66058 3/1998
JP A-10-155040 6/1998
JP 9-251599 4/1999
JP 11-160424 6/1999
WO WO90/04242 4/1990
WO WO95/27910 10/1995
WO WO96/12265 4/1996
WO WO9737336 10/1997
WO WO98/52174 11/1999

OTHER PUBLICATIONS

Nov. 24, 1976, TELEXIS ViaNet General Information Booklet Version 1.3.
2000, ViaNet 3000 Administrator's Manual Version 1.1—NetXpress Video by TELEXIS, Kanata, Ontario, Canada.
1999 Vianet 3000 Operator Manual Version 1.0—NetXpress Video by TELEXIS, Kanata, Ontario, Canada.
1999 ViaNet 3000 Administrator Manual Version 1.0—NetXpress Video by TELEXIS, Kanata, Ontario, Canada.
1999 ViaNet 3000 Instruction Manual Operator's Revision 1—NetXpress Video by TELEXIS, Kanata, Ontario, Canada.

* cited by examiner

NETWORKED PERSONAL SECURITY SYSTEM

This application is a continuation of patent application Ser. No. 11/057,264 filed on Feb. 14, 2005, now ABN, and entitled "Networked Personal Security System." The invention claims priority and is a continuation of patent application Ser. No. 09/974,337, filed Oct. 10, 2001, now U.S. Pat. No. 6,853,302, titled "Networked Personal Security System."

BACKGROUND OF THE INVENTION

1. Field of the Invention

The subject invention is generally related to personal security alarms or panic button devices and is specifically directed to a personal alarm system having network communication capability whereby the user can generate a signal to a remote location from any monitored area.

2. Description of the Prior Art

There are numerous devices that allow an individual to send a panic signal to a remote location in order to seek assistance when certain events occur. For example, many semi-invalid medical patients will wear a panic button as pendant around their neck, with the panic button adapted to be manually pushed in order to signal a medical emergency. The button device then transmits a signal to a remote monitoring station for initiating a response. Basically, the device transmits a radio signal to a receiver and identifies the patient. The response is typically a telephone call to the patient's residence and if no answer is received, emergency personnel are dispatched. This system works relatively well if the patient stays near the identified telephone or remembers to inform the monitoring system personnel of his/her whereabouts if he/she leaves an identified area. A major drawback to this system is the inability to track the location of a patient. Another drawback is the requirement that the panic button be manually activated in all circumstances. In certain situations, it may be impossible for the wearer to manually activate the system, rendering the panic system ineffective.

There are many applications both in the medical field and in other fields where a personal panic alarm system would be useful, particularly if the alarm identified the location of the personnel and even more so if under certain conditions the system were automatically activated. For example, such a device would be useful in school systems wherein the teaching staff could wear the panic button device and immediately signal security and/or administrative personnel of an incident. This would be particularly useful if the system identified the location of the teacher as well as in many instances identified the type of emergency. To date, no known devices provide such features and capability.

There are a number of devices available that address location tracking. As an example, U.S. Pat. No. 5,276,496 discloses an optical system for locating a target within a defined area by comparing the received light intensity between the several sensors. U.S. Pat. No. 5,355,222 discloses an optical position sensor, wherein an object with a luminous transmitter is viewed by an array of binary-patterned sensors. U.S. Pat. No. 5,548,637 discloses a telephone-forwarding system wherein people are 'tagged' with optical transmitters, and stationary receivers located throughout the premises determine the person's location and nearest telephone extension.

U.S. Pat. No. 4,275,385 discloses a personnel locator system wherein people carry coded infrared transmitters throughout a facility. Zoned receivers detect the coded signals and determine the person's location. U.S. Pat. No. 5,062,151 discloses a personnel location system, wherein people carry coded infrared transmitters, which activate infrared receivers in each equipped room.

While each of the prior art devices address certain location issues, none of the known devices provides an affordable, comprehensive personal signaling and locating device.

SUMMARY OF THE INVENTION

The subject invention is directed to a personal alarm system that is affordable, portable and fully compatible with a comprehensive security system such as that shown and described in my co-pending U.S. patent application Ser. No. 09/594,041, entitled: Multimedia Surveillance and Monitoring System Including Network Configuration, filed on Jun. 14, 2000. The device can be worn or carried by the user, may be activated at any time by the user and/or may be automatically activated to send a signal to any remote monitoring station on the network. The device also identifies the user as well as the user's location within the monitored area. In the preferred embodiment, the alarm-sending unit is designed to fit within a box the size of a small cell phone or pager. The unit includes an ID memory for identifying the user, and has on-board circuitry for generating a signal to a wireless transmitter for sending the signal to a to a local receiver for inputting the signal onto the network.

In one embodiment of the invention, the device can be worn on the person of key personnel for activating a signal that is transmitted to a remote location such as security personnel or a guard station processor or the like. As an example, the device of the present invention is particularly useful in aircraft applications where a crew member can send a distress signal directly to ground control in the event of an emergency or catastrophic event. In its simplest form, the device may be a wired "ON-OFF" button placed at a strategic location in the aircraft, such as, by way of example, on the control panel of the cockpit and/or in the galley or other strategic location in the passenger cabin. In an enhanced embodiment, the device is wireless and may be carried directly on the person of a crew member. Preferably, each crew member would be armed with the wireless device.

In its simplest form, the device simply sends an emergency signal to ground control, thus alerting ground control that an emergency has occurred and that the aircraft requires immediate monitoring and communication. In an enhanced embodiment, the device is linked to a comprehensive on-board security system and in addition to transmitting a signal to ground control, also activates the security system to collect additional data and store the data in the on-board recorders as well as optionally sending the data to the ground control in a live, real-time transmission.

One of the advantages of this system is that where loop recorders are used, such as, by way of example, thirty minute loop recorders common on many commercial aircraft, an activation signal can download the stored information and begin live transmission of new information. This permits the thirty minutes of data recorded prior to the incident to be received at ground control and minimizes the current dependency of finding the "black box" recorder. This also permits important data relating to the events prior to the incident as well as data after the incident to be collected for investigation and reconstruction of the event.

The wireless system has numerous advantages in preserving the ability to transmit emergency signals. For example, it is virtually impossible to simultaneously disarm all wireless components, preserving some transmission capability even if certain of the devices are disabled. Also, when used in combination with the comprehensive wireless system, it is possible to initiate and transmit information even after the integrity of the aircraft has begun to disintegrate.

In additional embodiments of the invention, the device may be more sophisticated to permit the type of emergency to be embedded in the emergency signal. For example, it is useful to distinguish between a fire emergency, a medical emergency and a security emergency since the response to each will be different.

The device of the subject invention is also well suited for use in facility security applications where roving personnel may have need for a personal alarm device in order to signal response personnel as to the presence of an emergency condition. For example, the device is very useful for teachers in managing classroom or campus emergencies. In this application, the device is location specific, not only sending a signal to the monitoring station, but also identifying the sender and the sender's location.

In one embodiment, a centralized, networked RF receiver is used with the personal alarm units. One or more of these RF receivers may be installed in order to provided adequate coverage of the monitored area. The signals generated by the personal alarm are received by the RF receiver(s) and decoded, whereupon the system processor assembles a message, packetizes it as necessary, and sends it to one or more monitoring stations via the intervening network and network interface The signals may be digitized where desired.

In an enhanced embodiment, beacon transmitters are installed at various locations around the monitored facility, again connected to a common facility network. The beacon transmitters are designed to transmit a unique beacon ID signal at regular intervals. The beacon signals may also be generated by a control signal from a system processor on the facility network. These signals may be infrared, RF, ultrasonic or other known format. The personal alarm unit will store the beacon signal each time it is received. When a signal is initiated from the personal alarm unit it will identify the location of the sender by transmitting the last stored beacon signal, providing an efficient, inexpensive and accurate method of tracking the user.

In large enclosed areas such as a gymnasium or auditorium multiple beacons may be employed for further refining the location of a sending unit. It is also an important feature of the invention that GPS technology may be employed in outdoor settings such as a stadium, campus grounds or the like. This is useful independently of the beacon technology, or may be employed in connection with the beacon technology in order to track location of a user both internally and externally while in the monitored area.

It is, therefore, an object and feature of the subject invention to provide a personal alarm device capable of transmitting a signal to a remote location upon activation.

It is also an object and feature of the subject invention to provide a personal alarm device capable of activating a security and surveillance system when the device is activated.

It is an additional object and feature of the subject invention to provide a personal alarm device for initiating the transmission of event data to a remote location when the device is activated.

It is also an object and feature of the subject invention to provide a personal alarm device capable of sending an alarm signal to a remote station while identifying the identity and/or the location of the user.

It is another object and feature of the subject invention to provide an efficient method of monitoring and identifying the location of each unit in the system.

It is an additional object and feature of the subject invention to provide the means and method for supporting a personal wireless alarm system via a local area network (LAN) or wide area network (WAN).

It is yet another object and feature of the invention to provide a personal alarm system that may be polled by the monitoring stations on demand.

It is another object and feature of the subject invention to provide a personal alarm that may automatically send a signal upon the occurrence of certain, specified events.

It is a further object and feature of the subject invention to provide a personal alarm capable of providing voice communication with the monitoring station.

It is a further object and feature of the subject invention to provide a personal alarm system capable of identifying the type of emergency causing the need to initiate a signal.

It is a further object and feature of the subject invention to provide an intercom feature, signaling designated stations and transmitting microphone signals to that station.

It is a further object and feature of the subject invention to signal the location of an intercom call to the called station, such as presenting a room name and/or a signaling icon on a map at the called station.

It is a further object and feature of the subject invention to provide an "open microphone" after the initiation of an emergency or intercom signal.

It is a further object and feature of the subject invention to incorporate the panic button receiver in multipurpose network appliances, such as wall clock appliances, video camera appliances, smoke detector appliances, and the like.

It is a further object and feature of the subject invention to incorporate the beacon transmitter (or receiver depending on the exact method of implementation) in multipurpose appliances, such as wall clock appliances, video camera appliances, smoke detector appliances, and the like.

Other objects and features of the invention will be readily apparent from the accompanying drawings and detailed description of the preferred embodiments.

DETAILED DESCRIPTION OF THE PREFERRED EMBODIMENTS

Figure 1:
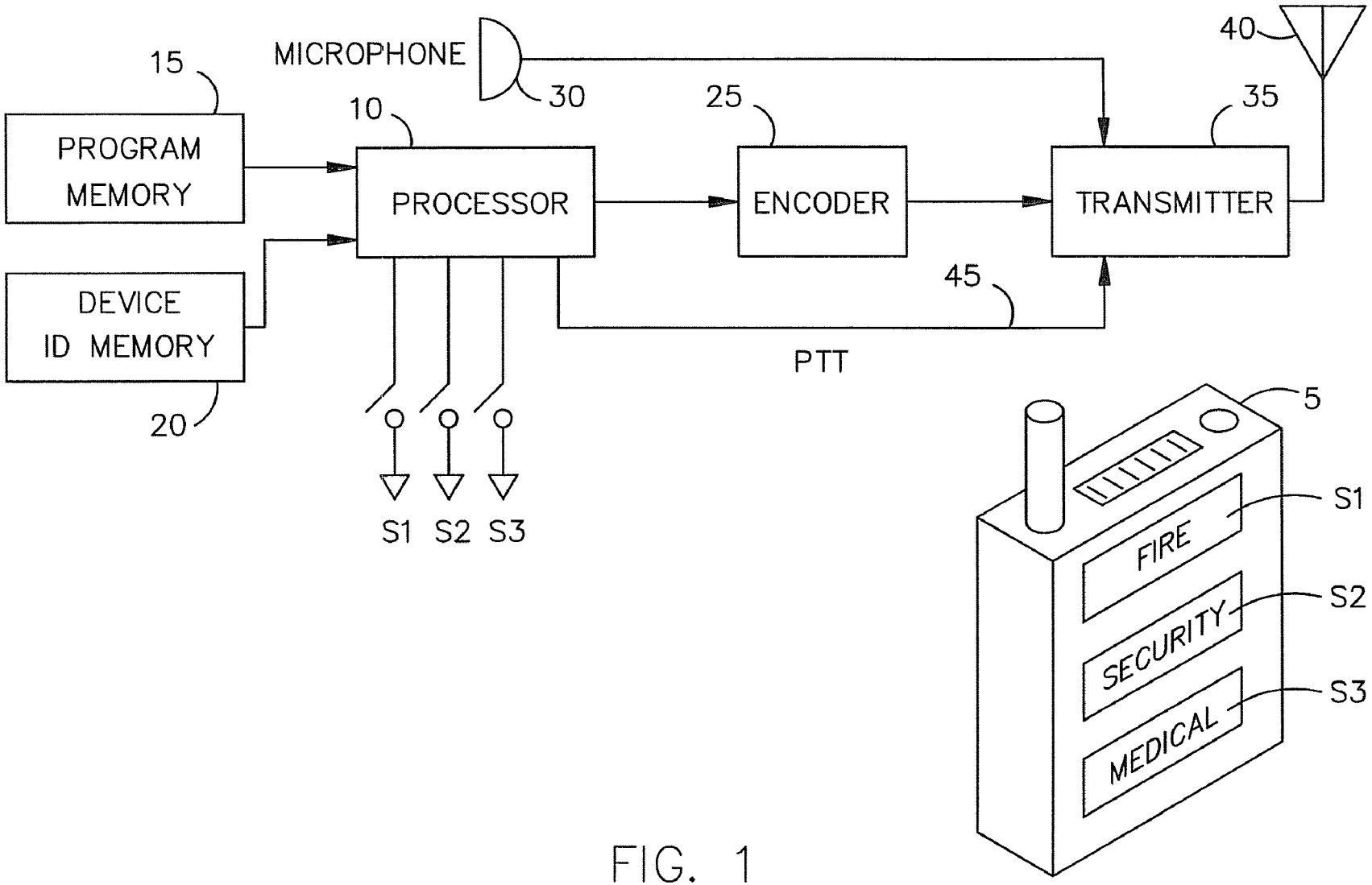
FIG. 1 is a perspective view of a basic personal alarm device in accordance with the teachings of the subject invention, including a basic block diagram of the circuitry for the device.
Figure 2A:
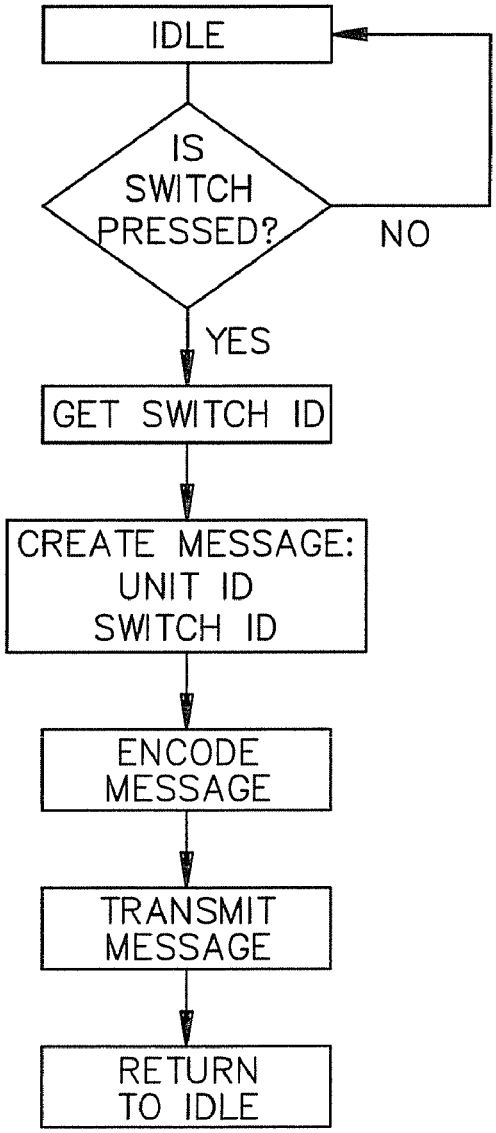
FIGS. 2A and 2B illustrate a decision flow diagram for one embodiment of the device.
Figure 2B:
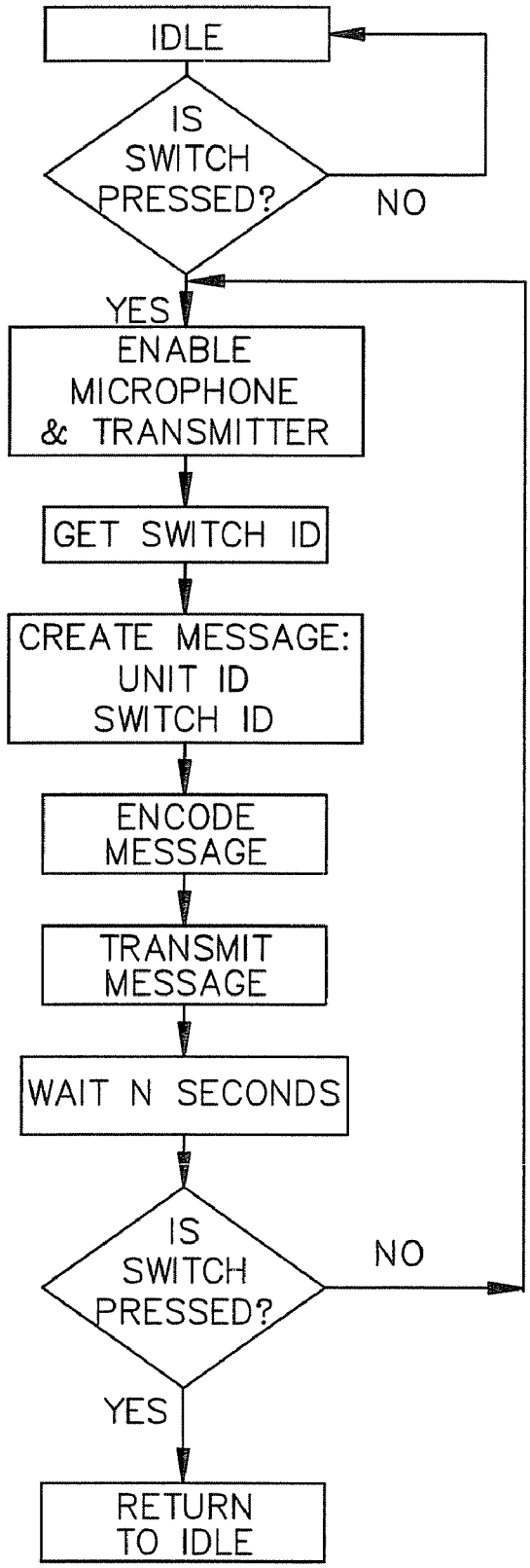
Figure 3:
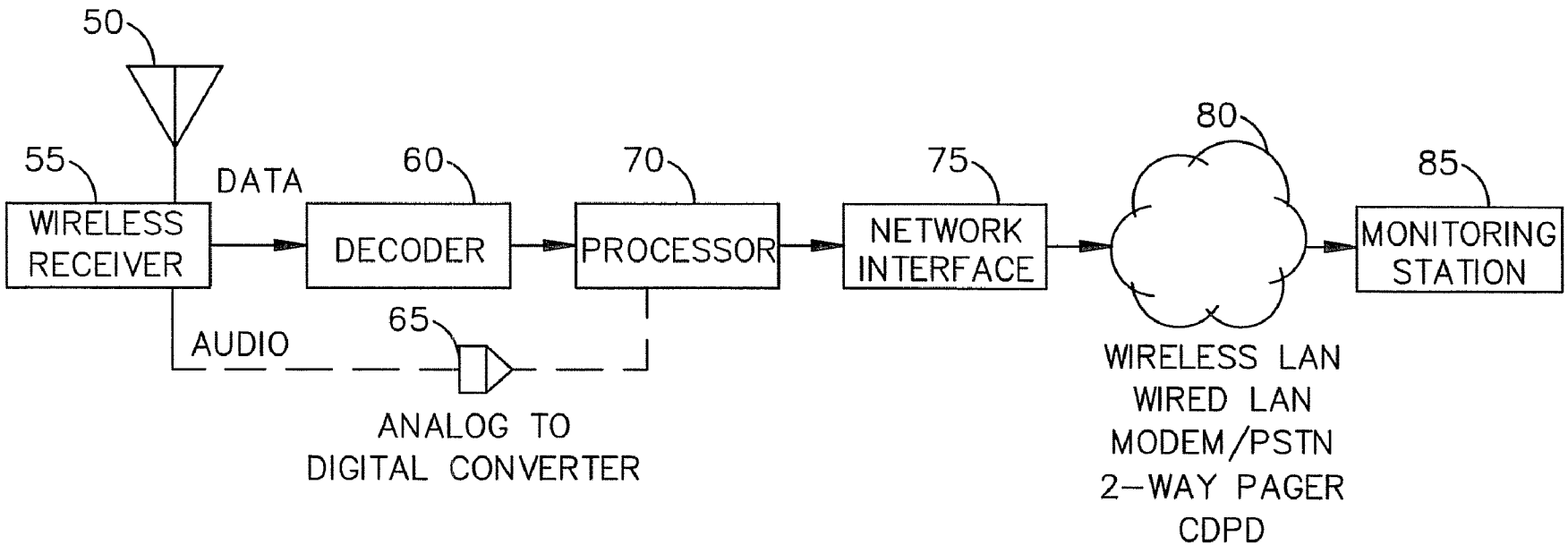
FIG. 3 is a diagram of a network system for supporting the device of the subject invention.

FIGS. 1-3 depict a basic embodiment of the system that does not included encoded location information. This application is particularly well suited for confined environments such as aircraft and the like, where the location of the person sending the signal is not as critical as in large installations such as a high school campus. In its simplest form, the alarm unit 5 of FIG. 1 comprises a simple panic button, which is a radiator that transmits a coded signal to the closest receiver via the antenna 40, with the receivers of FIG. 3 being conveniently located and connected to the network. Receivers can be integrated into other devices, such as wall clock appliances, thermostats, smoke detectors, motion detectors, and the like in the room or facility where the alarm unit is to be used. The transmitter radiator may comprise any of a number of signal generating protocols, such as, by way of example: RF (a potential location problem for certain applications in that it goes through walls so exact room location and identification is more difficult); LIGHT, such as IR, (directional and can be blocked by clothing and other obstructions); and ULTRASONIC (includes the dual advantages of being contained to a room, while not being as directional as IR and not so blocked by clothes. The specific method used will be dictated by the application and by cost/benefit factors and is well within the scope of knowledge of those skilled in the art.

Figure 10:
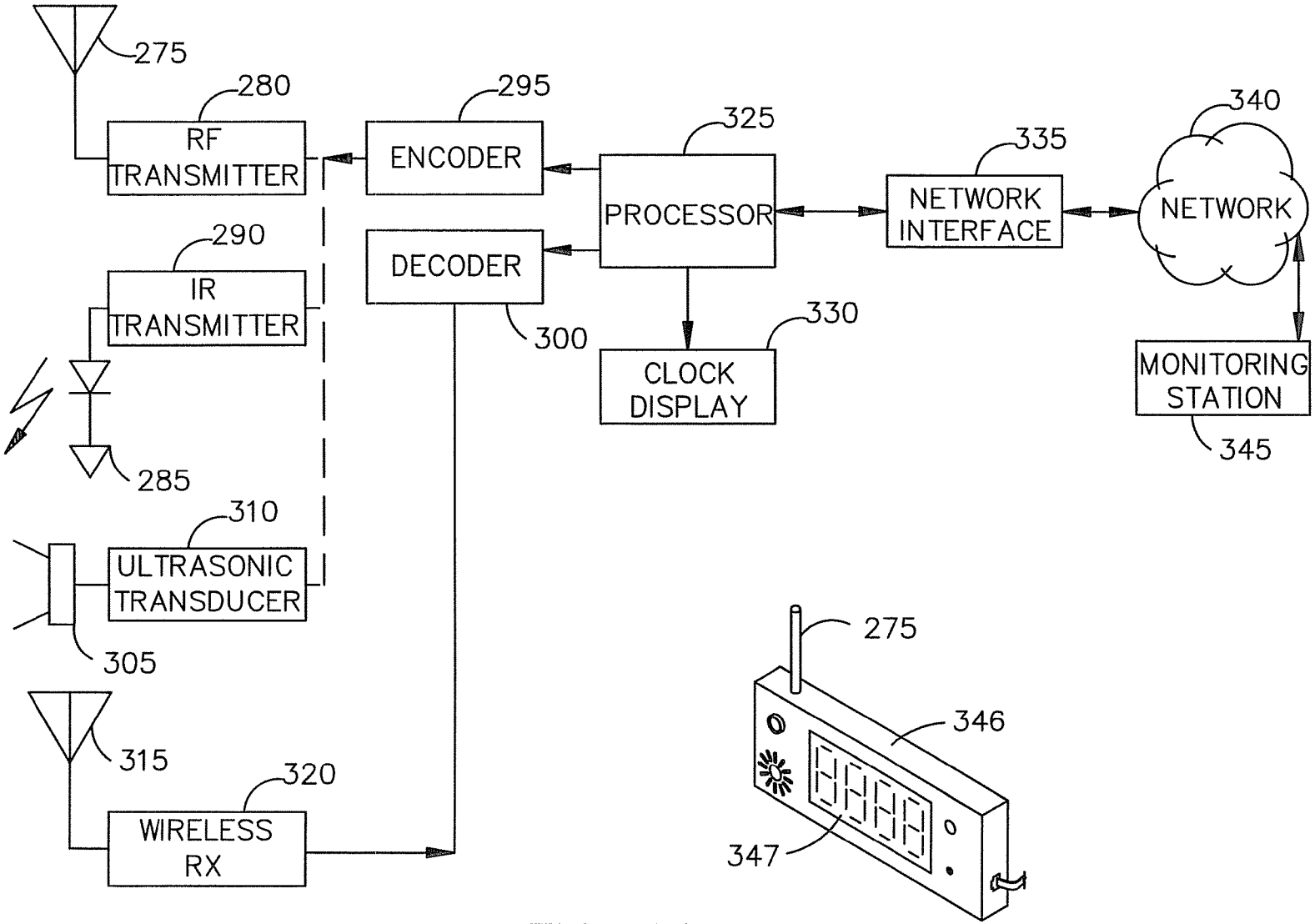
FIG. 10 illustrates a system for housing the beacon transmitter/receiver in a wall appliance.

The device of the subject invention may send the signal directly to a transmitter for sending the signal to a remote station, as shown in FIG. 1, or may be adapted for sending a signal to the installation security system for activating it as well, as shown in FIG. 10. A detailed description of aircraft security systems are shown and described in my issued U.S. Pat. Nos. 5,798,458, 6,009,356, 6,253,064B1, and 6,246,320B1, incorporated by reference herein. A detailed description of a comprehensive multimedia security system is shown and described in my copending application Ser. No. 09/594,041, filed on Jun. 14, 2000, entitled: "Multimedia Surveillance and Monitoring System Including Network Configuration, also incorporated by reference herein.

In most cases, the receiver of FIG. 3 will be incorporated in other appliances in the facility. For example, a room monitor in a school may be mounted on a wall and may include various sensors as well as the receiver. A detailed description of such devices is incorporated in my co-pending application entitled: Multimedia Network Appliance for Security and Surveillance Applications, Ser. No. 09/966,130, filed on Sep. 21, 2001, and incorporated herein by reference. Accordingly, FIG. 1 shows a wireless personal alarm 5, housed in an enclosure similar to a pager. The alarm has one or more pushbutton switches S1-S3, to notify a monitoring station of an emergency condition. As depicted in FIG. 2A, upon activation via switches S1, S2, or S3, the internal processor 10 of FIG. 1 encodes and transmits a message containing the personal alarm unit ID number and the emergency ID number. Optionally, the alarm may be arranged to transmit audio from the environment near the pager as depicted in FIGS. 1 and 2B. Microphone audio may be transmitted using conventional analog methods, or may optionally be digitized and compressed via A/D converter 31 and compressor 32 in FIG. 1. For example, either of the following schemes may be utilizes: analog transmission of the microphone from the panic button with A/D and optional compression at the receiver/appliance end, or optional compression and digital transmission at the panic button end, with digital reception and digital relay at the receiver/appliance end.

It should be understood that the terms encoder and decoder as used throughout the application are intended to mean modules adapted for modifying a transmitted signal so that it is compatible with a receiver. In the simplest form, wherein the signal generator and the signal receiver are fully compatible, the encoder and decoder modules are unnecessary. In other instances, the protocol may have to be modified, or an analog signal may have to be converted to a digital signal and vice versa. In some instances, where it is clear that a signal is generated in an analog format (such as an analog microphone, see microphone 30 in FIG. 1) and is processed by a digital module (see the compressor 32 in FIG. 1) the "encoder" or "decoder" may be illustrated as a simple A/D converter.

The audio may be transmitted as analog or digital. If analog, it needs to be digitized and optionally compressed before introduction to the LAN or WAN network.

FIG. 3 depicts a centralized, networked RF receiver used with the personal alarm units. One or more of these RF receivers may be installed in a facility to provide adequate coverage of the premises. Personal alarm signals received by antenna 50 are demodulated by the wireless receiver 55. These received messages are decoded via decoder 60, and passed to system processor 70. Processor 70 thereupon assembles a message, packetizes it if necessary, and sends it to one or more monitoring stations 85 via the intervening network interface 75 and network 80. Optionally, audio transmitted by an active personal alarm unit and received by the wireless receiver 55 may be digitized by A/D converter 65, then packetized by processor 70, and conveyed to the monitoring station(s) via the network and associated interface. If the microphone audio had been transmitted digitally, then the system processor 70 need only packetize the audio data prior to transmission via network interface 75.

As indicated in the drawing the network can be a wireless LAN (WLAN), a wired LAN, a modern/PSTN (public switched telephone network), two-way pager, CDPD, or other suitable network system. One embodiment of a suitable network system is shown and described in my previously mentioned co-pending application Ser. No. 09/257,720, entitled: Network Communication Techniques for Security Surveillance and Safety System.

Figure 4:
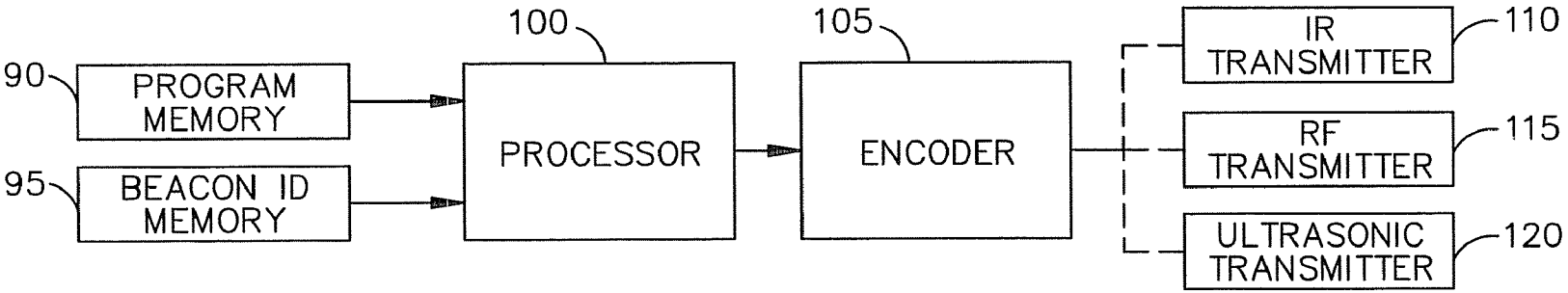
FIG. 4 illustrates a beacon transmitter, which operates without a supporting facility network.
Figure 4:
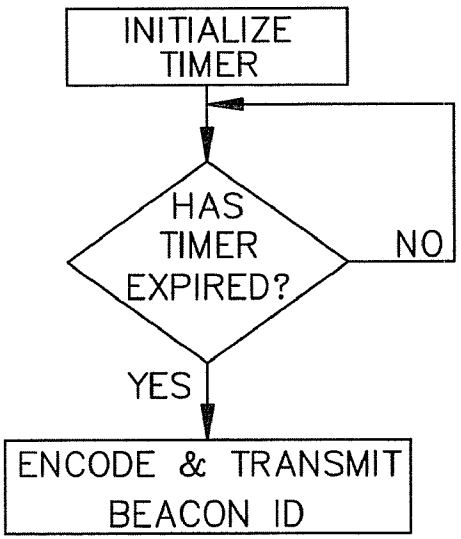
Figure 5:
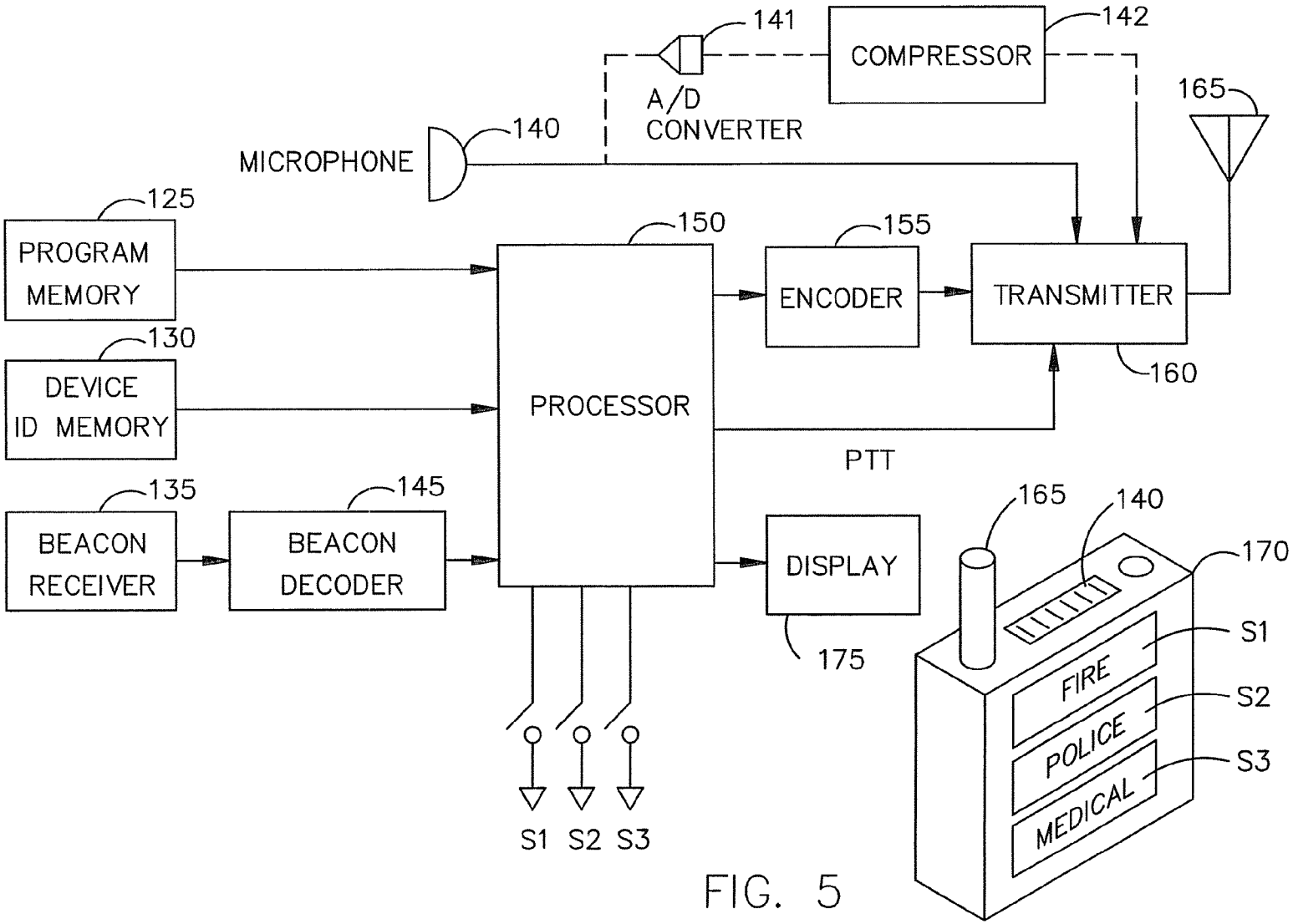
FIG. 5 is a perspective view of an enhanced personal alarm device with additional features, including a basic block diagram of the circuitry for the device.

FIGS. 4-6 illustrate a useful enhancement to the system, wherein numerous beacon transmitters are installed at various locations around the facility. Beacons transmit their unique ID to Personal Alarm Units, which thereby maintain a knowledge of the ID of the nearest beacon. When a Personal Alarm Unit needs to transmit an emergency indication, it can thereby notify one or more facility receivers of its ID, nearest beacon ID, and the type of emergency.

As shown in the circuit in FIG. 4, the beacon transmitters are not required to be attached to any common network, and transmit a unique Beacon ID number at regular intervals. The beacons may employ infrared, RF, or ultrasonic energy to transmit their ID in to the local area. In the embodiment shown, each beacon transmitter includes a processor 100 with program memory 90 and a beacon ID memory 95 for introducing unique beacon identifying signals to the processor 100. The processor output is encoded at encoder 105 and sent to the various transmitters such as the IR transmitter 110, the RF transmitter 115, or the ultrasonic transmitter 120 and the like. A typical sequence is shown in the flowchart of FIG. 4, showing that once the timer is initialized the beacon identification signal will be blocked from transmission until the expiration of a pre-selected timer interval, In FIG. 5, an enhanced personal alarm is equipped with a beacon receiver, using infrared, RF, or ultrasonic methods as in the case of the beacon. The personal alarm unit receives and stores the ID number of the nearest beacon, as indicated at beacon receiver 135. The personal alarm unit receives the identifying signal from the beacon via beacon receiver 135. The beacon ID number is decoded by beacon decoder 145 and introduced into the unit processor at 150. As in the embodiment of FIG. 1 the program memory 125 and device ID memory 130 provide device specific identify data to the processor. When one of the switches S1, S2, or S3 is depressed, processor 150 formulates a message containing the personal alarm ID, the most recent beacon ID, and an indication of which switch was pressed. In this embodiment the encoder 155 encodes the processor output and introduces it to the transmitter 160 for wireless transmission via the antenna 165. The microphone 140 permits direct audio input to the system from the unit. Audio may be transmitted in analog form, or may be digitized by A/D converter 141 and compressed by compressor 142, thence transmitted digitally. The unit is shown at 170 and includes the activation switches S1, S2, S3, the microphone 140 and the antenna 165.

Optionally, the personal alarm may store more than one beacon ID number for those cases where the personal alarm unit is moving through the facility, or may be in an area covered by more than one beacon.

Figure 6A:
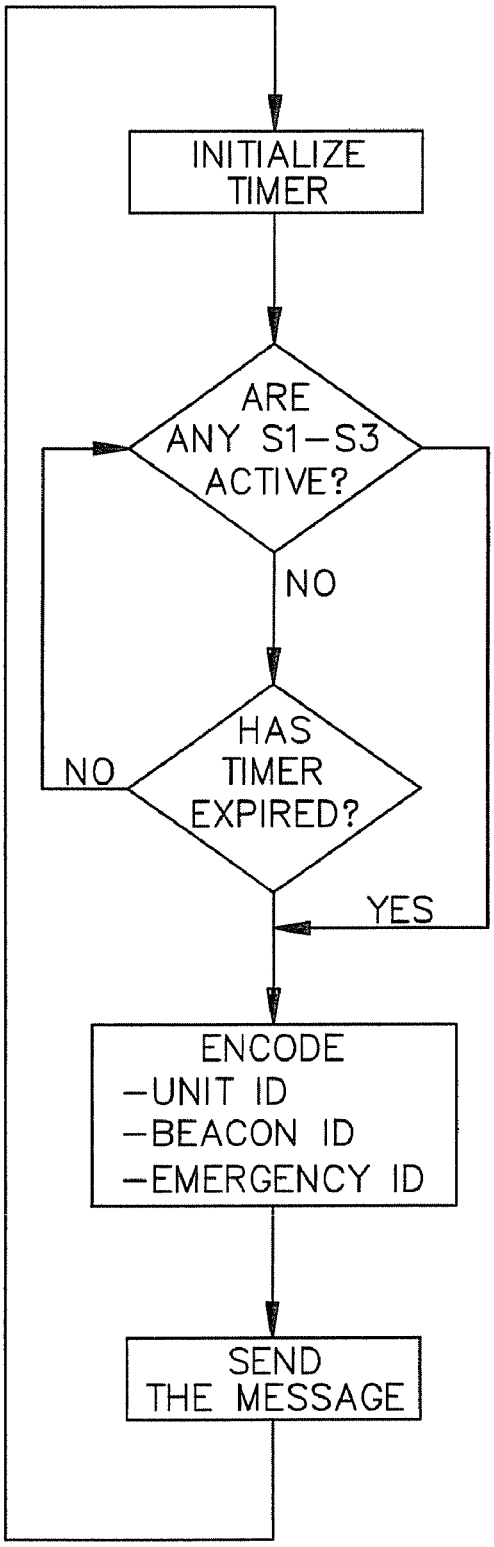
FIGS. 6A and 6B illustrate the decision flow diagram for the device as modified in FIG. 5.
Figure 6B:
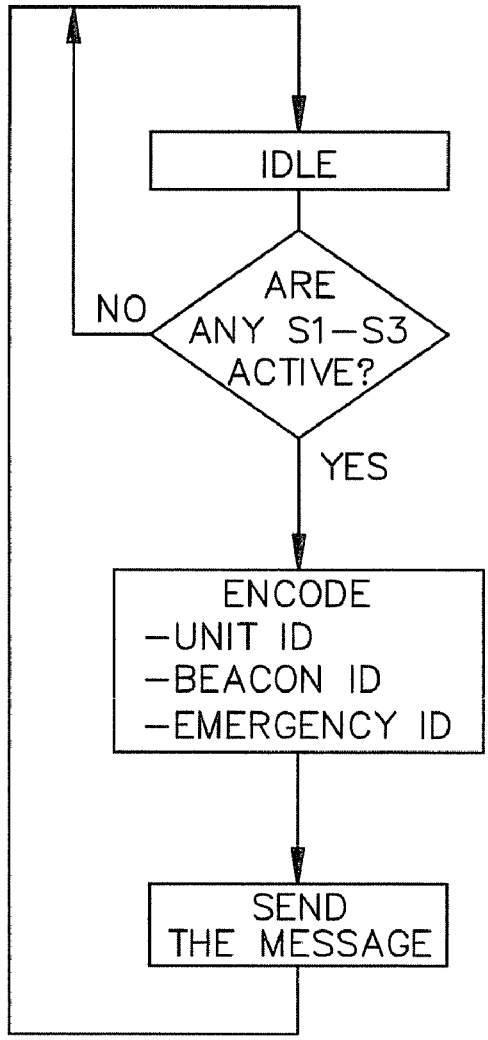

It will be noted that the receiver is programmed to listen for or sense beacons and to store the last one detected. Then if a panic button is pressed when the panic button unit IS NOT in range of a beacon, the last know beacon ID will be used for transmission of location. This would perhaps not send the exact location, but would be close because it is the last substantiated location. As shown in FIGS. 6A and 6B, the personal alarm units may operate in either a continuous fashion, or in an as-needed fashion. In FIG. 6A, the personal alarm periodically sends it's unit ID number, last beacon ID number(s), and emergency ID number (if any). In FIG. 6B, the personal alarm transmits only when one of switches S1-S3 are activated. The beacon generators do not necessarily need to be networked, which permits that common power be used. Networked beacon generators require network wiring, or wireless network infrastructure.

Figure 7:
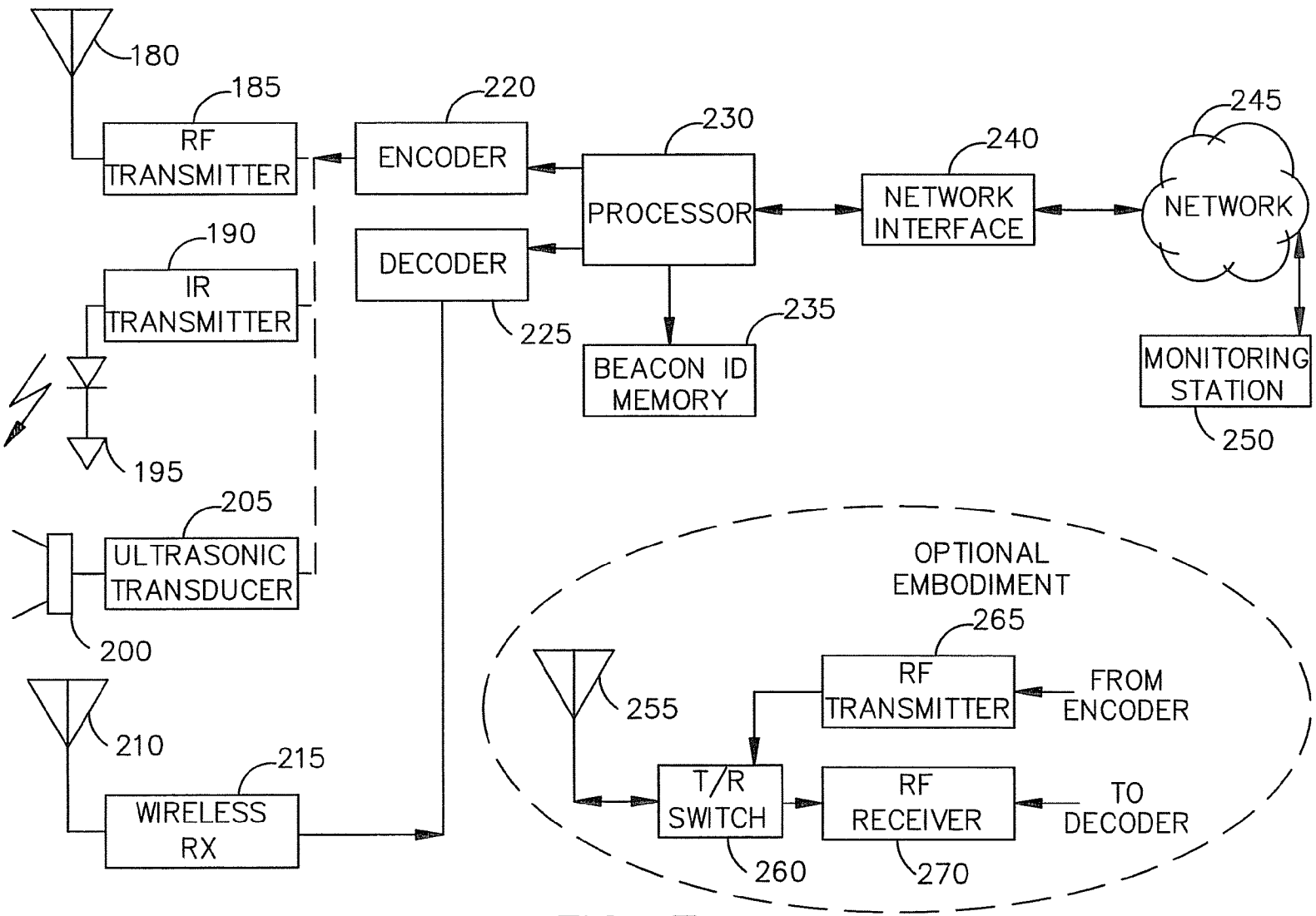
FIG. 7 illustrates a comprehensive system incorporating the teachings of the subject invention.

The utility of the system may be greatly enhanced by connecting all the facility's beacon units to a common network, as depicted in FIG. 7. In this enhancement, the beacon transmitter of FIG. 4 is equipped with a wireless receiver, to receive transmissions from personal alarm units within it's immediate area. Additionally, the beacon transmitter/receiver is connected to a network or LAN serving the facility, allowing emergency transmissions from personal alarm units to be disseminated throughout the network. As before, the beacon transmits its unique beacon ID number into the local area, again using infrared, RF, or ultrasonic methods, as indicated by the antenna 180 and RF transmitter 185, the IR transmitter 190 and generator 195, ultrasonic transducer 205 and generator 200, respectively. The beacon ID memory is provided by a discrete memory circuit 235. Additionally, the beacon unit of FIG. 7 has a RF receiver 215 with antenna 210, capable of receiving the transmissions from the personal alarm units of FIG. 1 or FIG. 5, if any, located within its immediate area. The signal received and demodulated by the wireless receiver 215 is decoded at decoder 225 and introduced into the processor 230. The processor formulates a message containing the personal alarm ID, alarm type, and beacon number transmitted by the personal alarm unit. This message is introduced to the network 245 via the network interface 240 for transmission to the monitoring station 250. The antenna 255 provides the means for transmitting and receiving signals from the RF transmitter 265 and the RF receiver 270 via a transmitter/receiver switch 260, permitting reduction of circuit redundancies. Since each beacon unit has it's own wireless receiver for receiving emergency transmissions from the personal alarm units, the beacon units may supplement or replace the facility-wide RF receivers depicted in FIG. 3.

In an alternative embodiment, the dual antennas 180 and 210 in FIG. 7 may be replaced by a single shared antenna. In this embodiment, a transmit/receive switch 260 connects antenna 255 to either transmitter 265 or receiver 270. As before, the output signal from encoder 220 is passed to the RF transmitter 255, whilst the output from RF receiver 270 is passed to decoder 225 for decoding.

Figure 8:
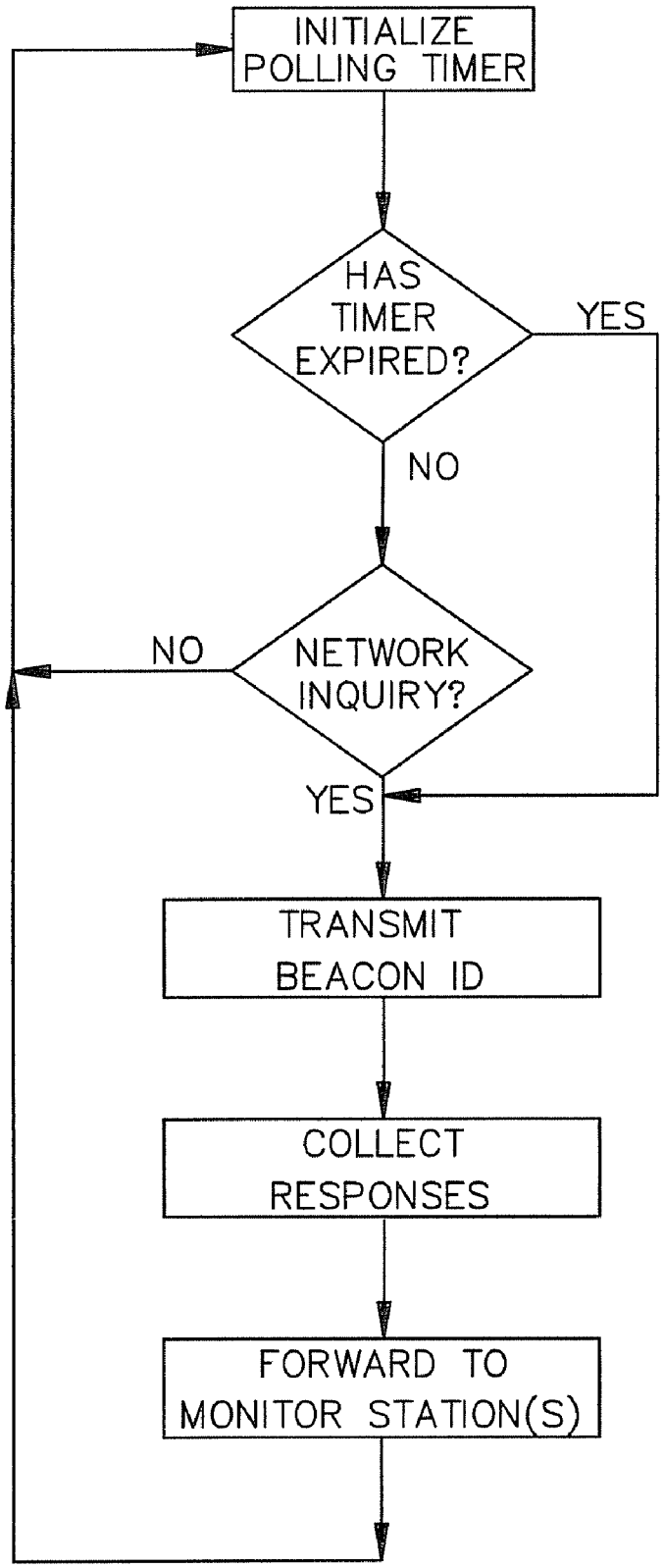
FIG. 8 is the timing decision flow diagram for the configuration of FIG. 7.
Figure 9A:
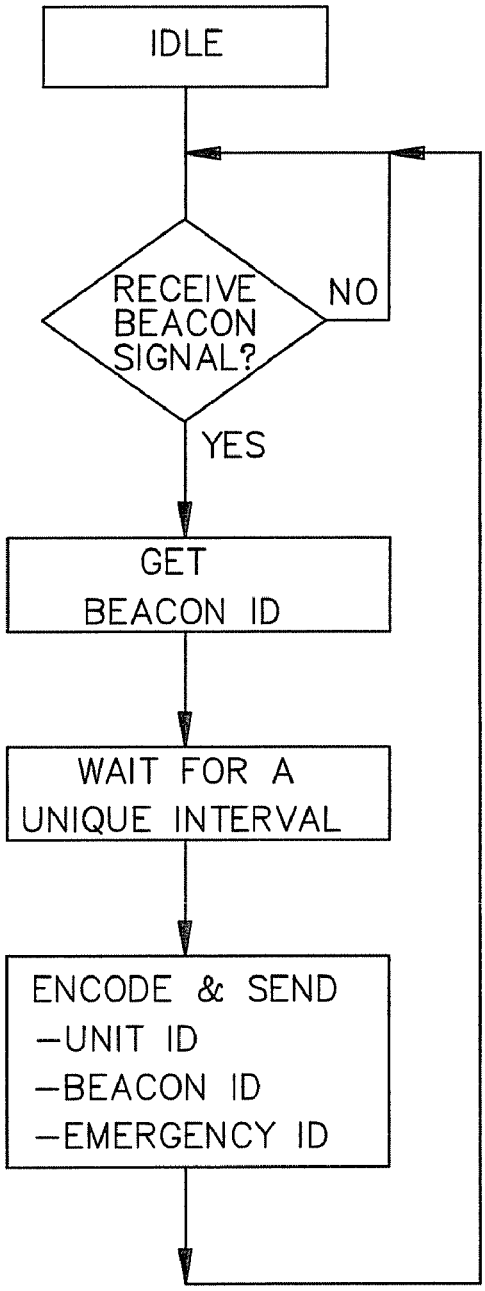
FIGS. 9A and 9B illustrate a beacon signal management system for supporting beacon signal management of a system in accordance with the subject invention.

As shown in the flowchart of FIG. 8, the beacons transmit their beacon ID at regular intervals, based on an internal timer. The beacon may additionally transmit its beacon ID upon request from the monitoring station(s). The personal alarm units from FIG. 5 may interact with the networked beacon of FIG. 7 according to the flowcharts of FIG. 9A and FIG. 9B. In FIG. 9A, the personal alarm unit receives the beacon signal, decodes the beacon ID number, waits for a unique time interval to pass, then encodes and sends it's unit ID, received beacon ID, and emergency ID (if any). The unique time interval is derived from the personal alarm unit's ID number, such that no two personal alarm units will have the same interval. That prevents the case where multiple personal alarm units respond to the beacon at the same instant, and thereby mutually interfere.

Figure 9B:
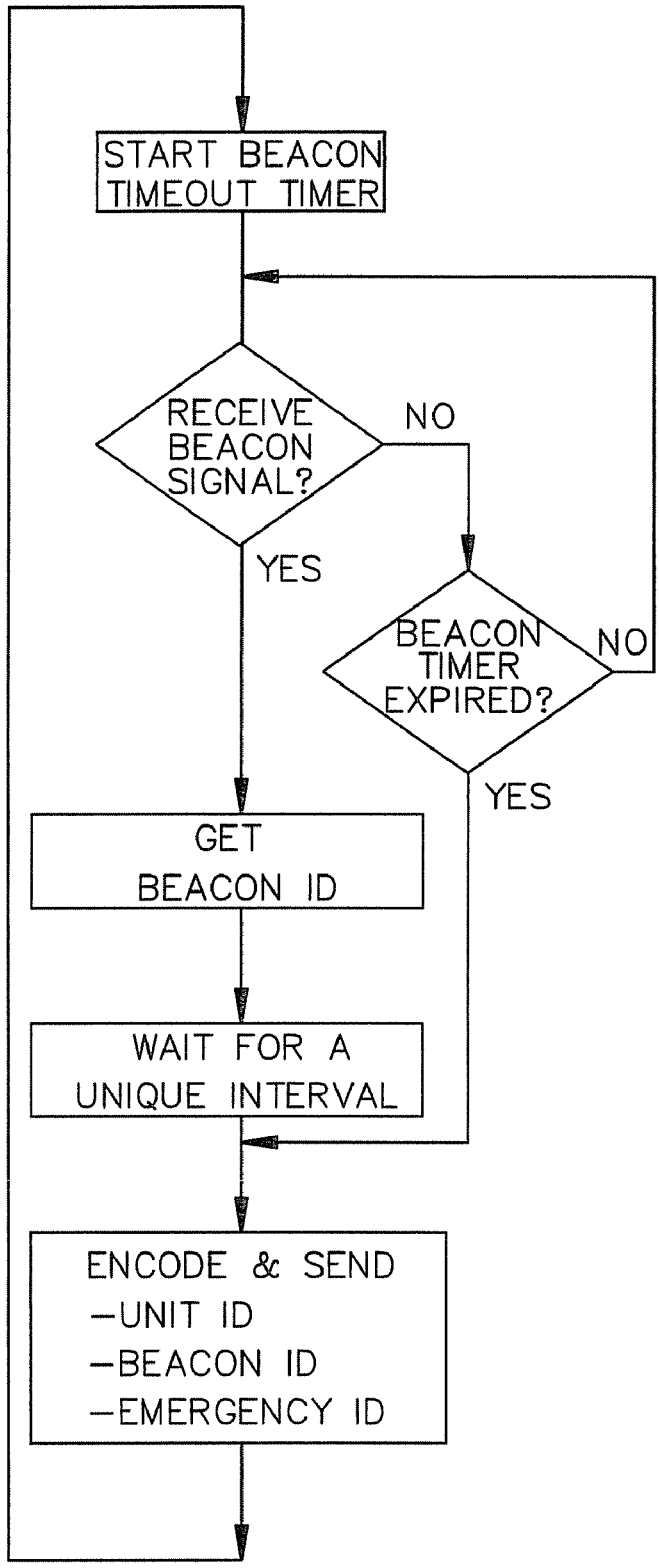

In FIG. 9B, the personal alarm unit responds to a beacon's transmission, as before. Additionally, the personal alarm contains a timer that determines when an excessive time has elapsed with no beacon signal received. Upon this detection of beacon loss, the personal alarm transmits it's unit ID number, last-heard beacon ID number, and emergency ID (if any) at periodic intervals. A facility-wide receiver as in FIG. 3 may receive such transmissions.

FIG. 10 depicts a beacon transmitter/receiver housed in a wall clock. Suitable network time protocols may be employed to accurately time-stamp received alarms, as well as to set the clock. The time stamped location data thus derived may be useful in reconstructing a person's movements around the facility. As shown, the beacon signal may be transmitted using RF techniques (transmitter 280 and antenna 275), IR techniques (transmitter 290 and diode 285) or ultrasonic techniques (transducer 310 and generator 305). As previously described, the panic button may transmit an ID signal to the system via the antenna 315 and the wireless receiver 320 (such as the networked appliance as shown and described in my aforementioned U.S. patent application Ser. No. 09/966,130). The encoder 295 and decoder 300 are connected to the processor 325, as previously described, for providing a signal link to the network 340 and monitor 345 via the network interface 335. The clock configuration is shown at 346 with a digital clock display such as LED, LCD or electrolumenescent 347 and the signal antenna 275.

In another embodiment for implementing the geo-location system where there is no beacon, but there are networked receiver appliances available the panic button will send a continuous signal, allowing continuous location determination via the networked appliance for automatic call dispatch and other responses as described. In the alternative, the panic button signal will be generated only when a button is pushed, with the receiving networked appliance providing the location information.

Figure 11:
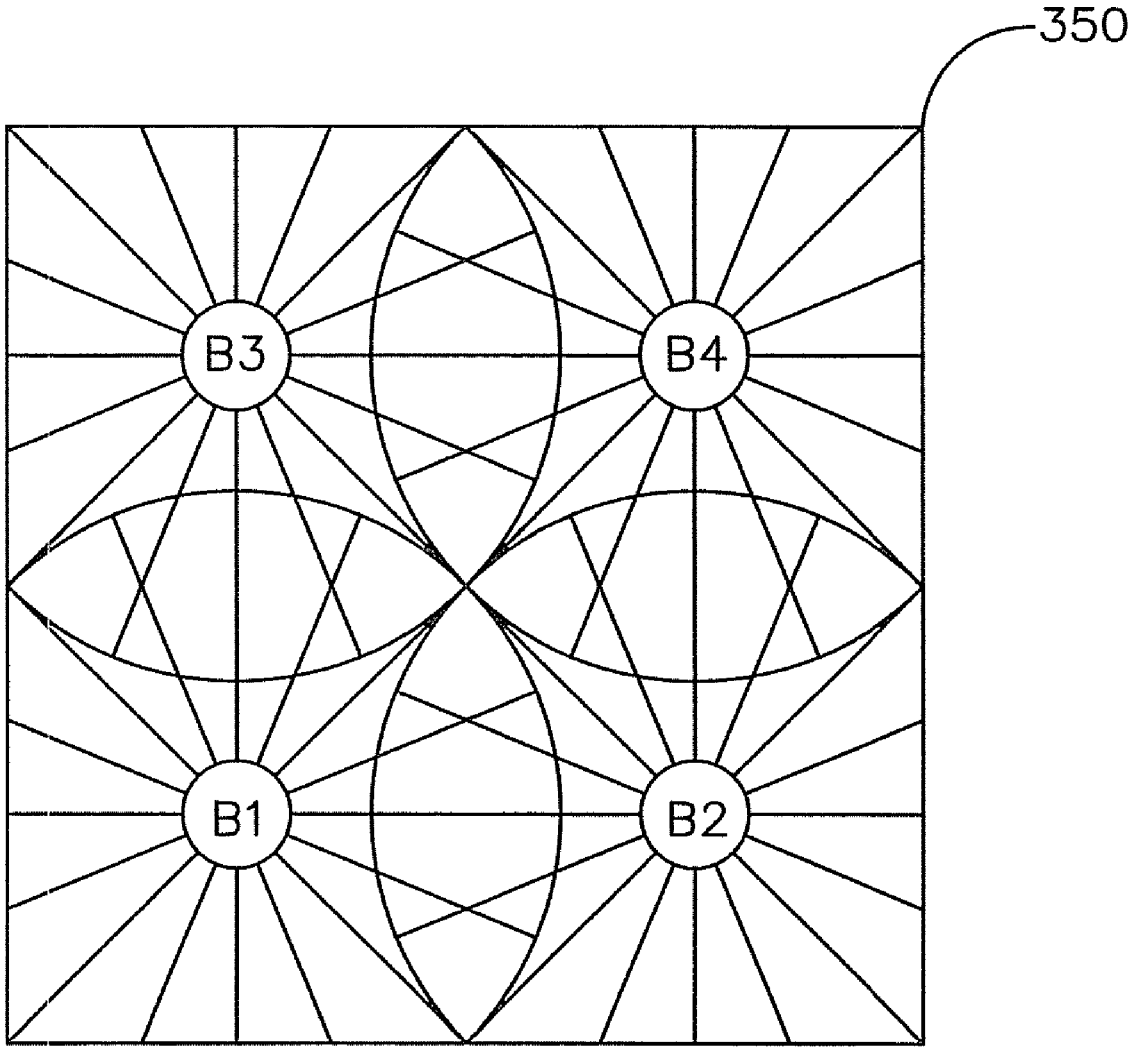
FIG. 11 shows a scheme for providing complete coverage of a target area utilizing strategically placed beacon transmitters/receivers.

As illustrated in FIG. 11, large enclosed areas such as auditoriums or gymnasiums (the outer boundaries or walls of which are shown as line 350) multiple beacons may be employed. As depicted in FIG. 11, the beacons B1, B2, B3, B4 are deployed so as to have overlapping areas of coverage, such that a personal alarm unit is always within range of at least one beacon. Activated, the personal alarm unit can transmit the beacon ID number of all beacons it currently receives, or make a decision about the ID that is transmitted based on signal strength, frequency of beacon receptions, or other criteria.

Figure 12:
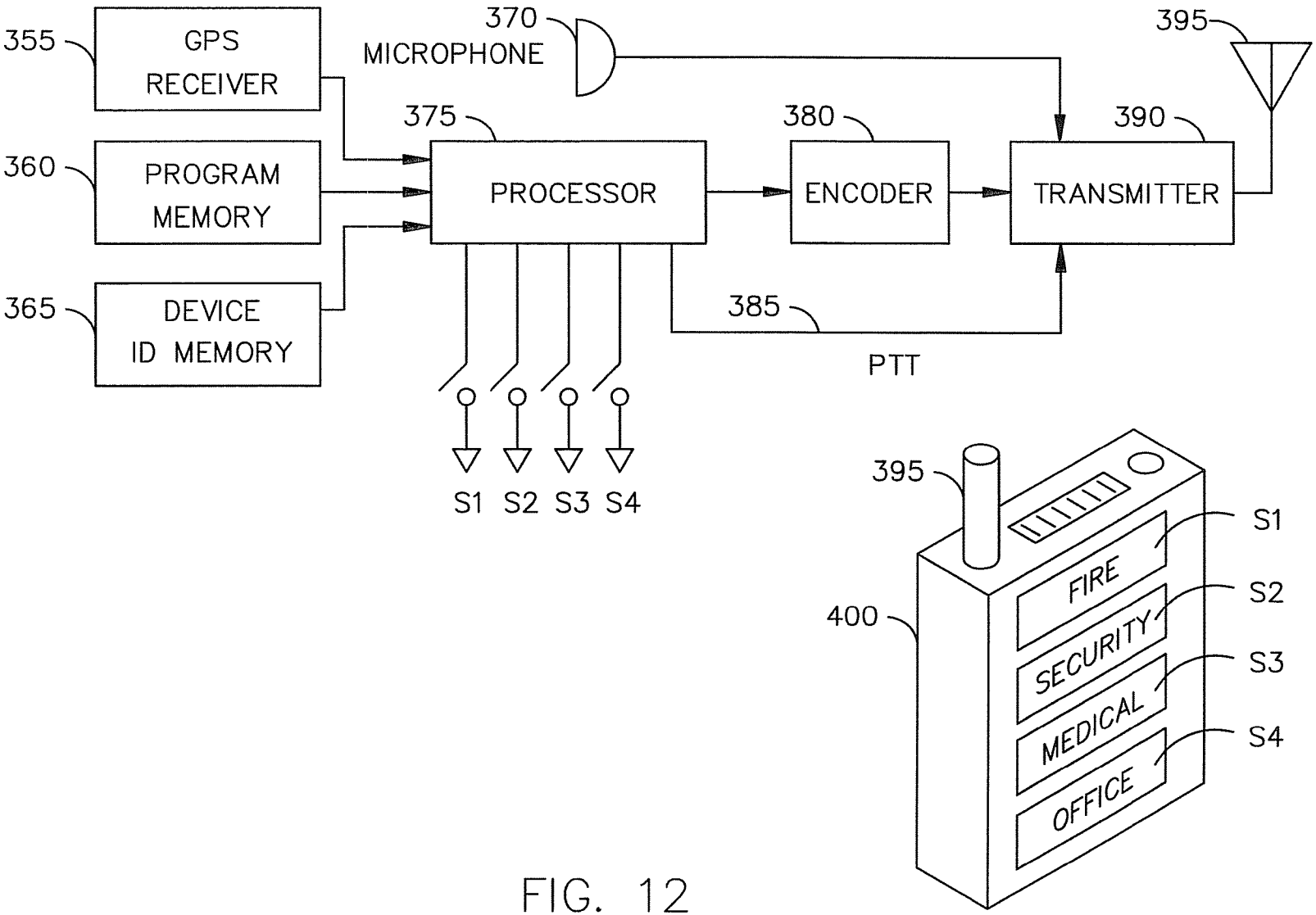
FIG. 12 depicts an adaptation of the system to support usage in a large outdoor area such as a stadium.

FIG. 12 depicts an adaptation of the system to support usage in a large outdoor area such as a stadium. Such an area may be beyond the range of the beacon transmitters, such that the personal alarm unit 400 does not have any beacon location information available to send upon demand. In this instance, the personal alarm unit is supplemented with a GPS receiver 355. When the alarm is activated by activation of switches S1, S2 or S3, or periodically activated by the processor 375 at predetermined intervals, the personal alarm unit sends its unit ID number and other identifying information from memories 365 and 360, GPS coordinates from receiver 355, and emergency code as indicated by the selection of switch S1, S2 or S3 (if any). For improved accuracy, the GPS data may be supplemented with DGPS correction data. The processed signals communicate with the system receiver via encoder 380, transmitter 390 and antenna 395.

An office button 54 may also be included. In the illustrated embodiment this is an intercom activation button permitting audio transmission between the unit and the office either directly through the unit or by remotely activating the networked intercom appliance in the operating range of the unit. This can be used in both emergency and non-emergency situations, using the microphone on the unit to send audio, and the nearest speaker to receive audio. The unit could also have a numeric keypad (not illustrated) so that intercom numbers can be dialed.

Figure 13:
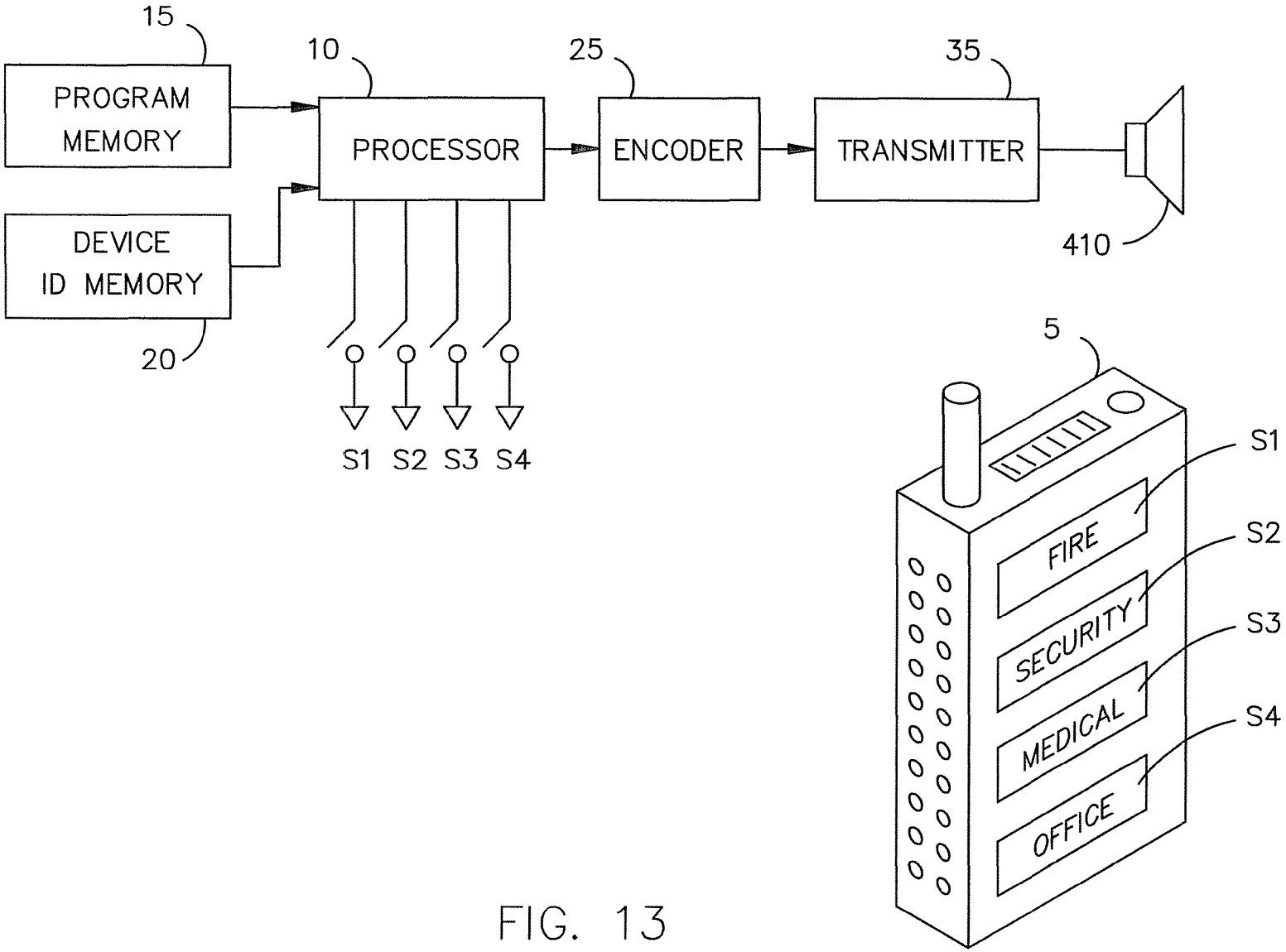
FIG. 13 depicts a modification of the system of FIG. 1 incorporating an ultrasonic transducer for transmitting encoded information.

FIG. 13 depicts an adaptation of the system of FIG. 1 wherein the personal alarm 5 uses an ultrasonic transducer 410 to transmit encoded information to a nearby receiver. The example personal alarm unit 5 has four switches or pushbuttons S1-S4, which are labeled, by way of example, FIRE, SECURITY, MEDICAL, and OFFICE. Other functions may be included without departing from the intent and spirit of the invention. When a pushbutton is depressed, the processor 10 retrieves the unique device identification number from memory 20. The processor subsequently composes a short message containing the device ID and data describing which button was pressed by the user. This message is then encoded by the encoder 25 and transmitted by the transmitter 35 and the ultrasonic transducer 410.

Figure 14:
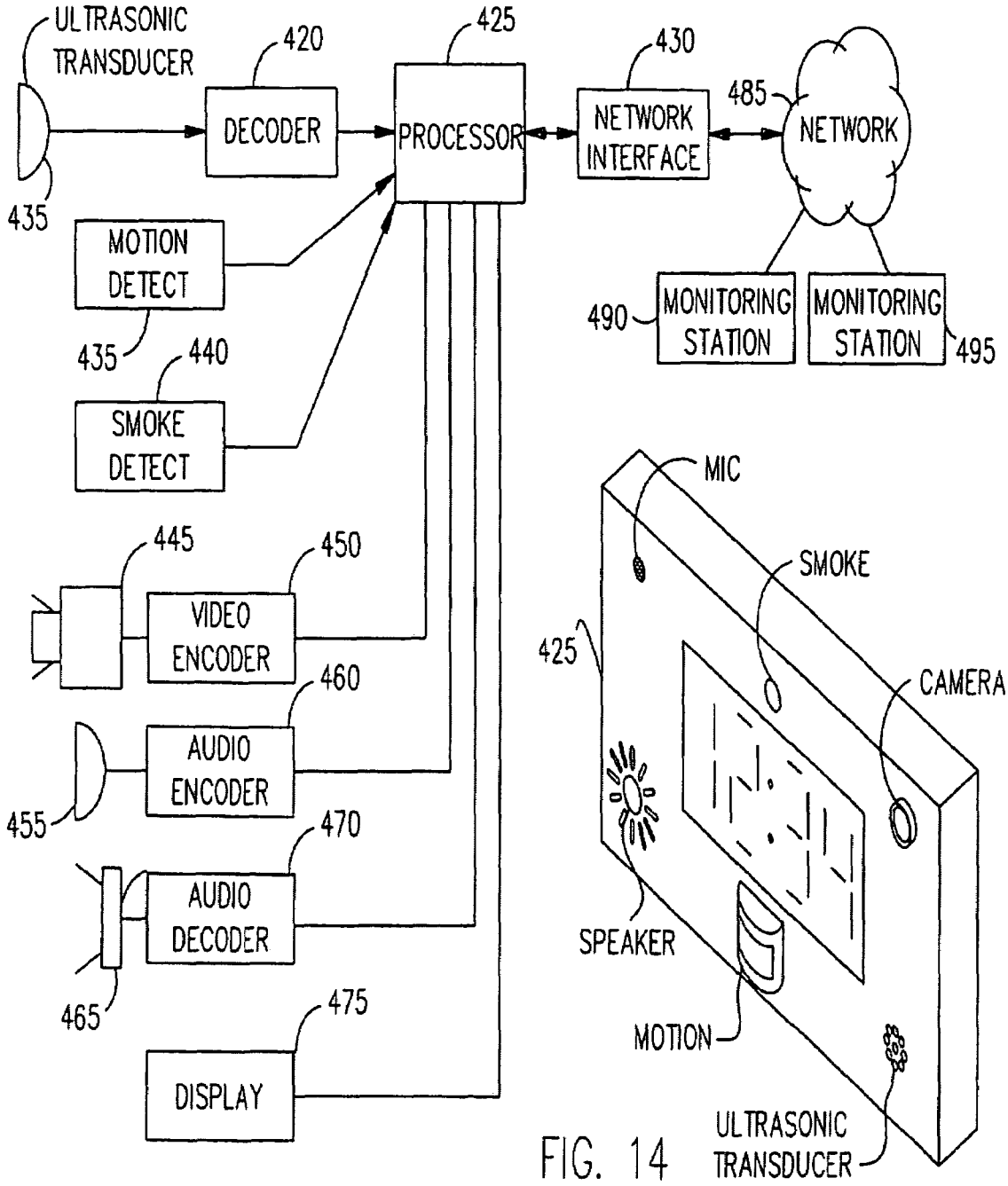
FIG. 14 illustrates a system for receiving, processing and disseminating the message received from a handheld device by a local networked appliance.

The transmitted message is received, processed, and disseminated by the room appliance 480 as shown in FIG. 14. The ultrasonic transducer 415 receives the transmitted signal. The signal is decoded by the decoder 420 and interpreted by processor 425. The processor then composes a short message containing the identification number transmitted by the personal alarm, the location of the receiving appliance, and where applicable, the type of message transmitted. The message may be sent to a number of appropriate monitoring stations anywhere on the network.

Optionally, the room appliance may contain a variety of related devices and functions as described more fully in my aforementioned co-pending application entitled: Networked Room Appliance. For example, the appliance 480 includes a motion detector 435 and a smoke detector 440. Conditions detected by these detectors, such as a fire or a motion detected after hours, are sent to the processor 425 which then generates a signal for alerting an appropriate monitoring station 490 or 495 via the network interface 430 and the network 485. A video camera 445 and encoder 450 may be commanded to capture and transmit visual images from the room to the monitoring stations 490 or 495. The microphone 455 and associated audio encoder 460 may be commanded to capture ambient sounds and likewise transmit them to the monitoring stations 490 and/or 495. Conversely, the user at monitoring station 490 or 495 may speak to occupants of the room via the intervening network 485, processor 425, audio decoder 470 and loudspeaker 465. The appliance 480 may also contain an information display 475 capable of displaying useful information generated by a device on the network or by a monitoring station 490 or 495. A common use of the display 475 would be a simple time-of-day clock.

Figure 15:
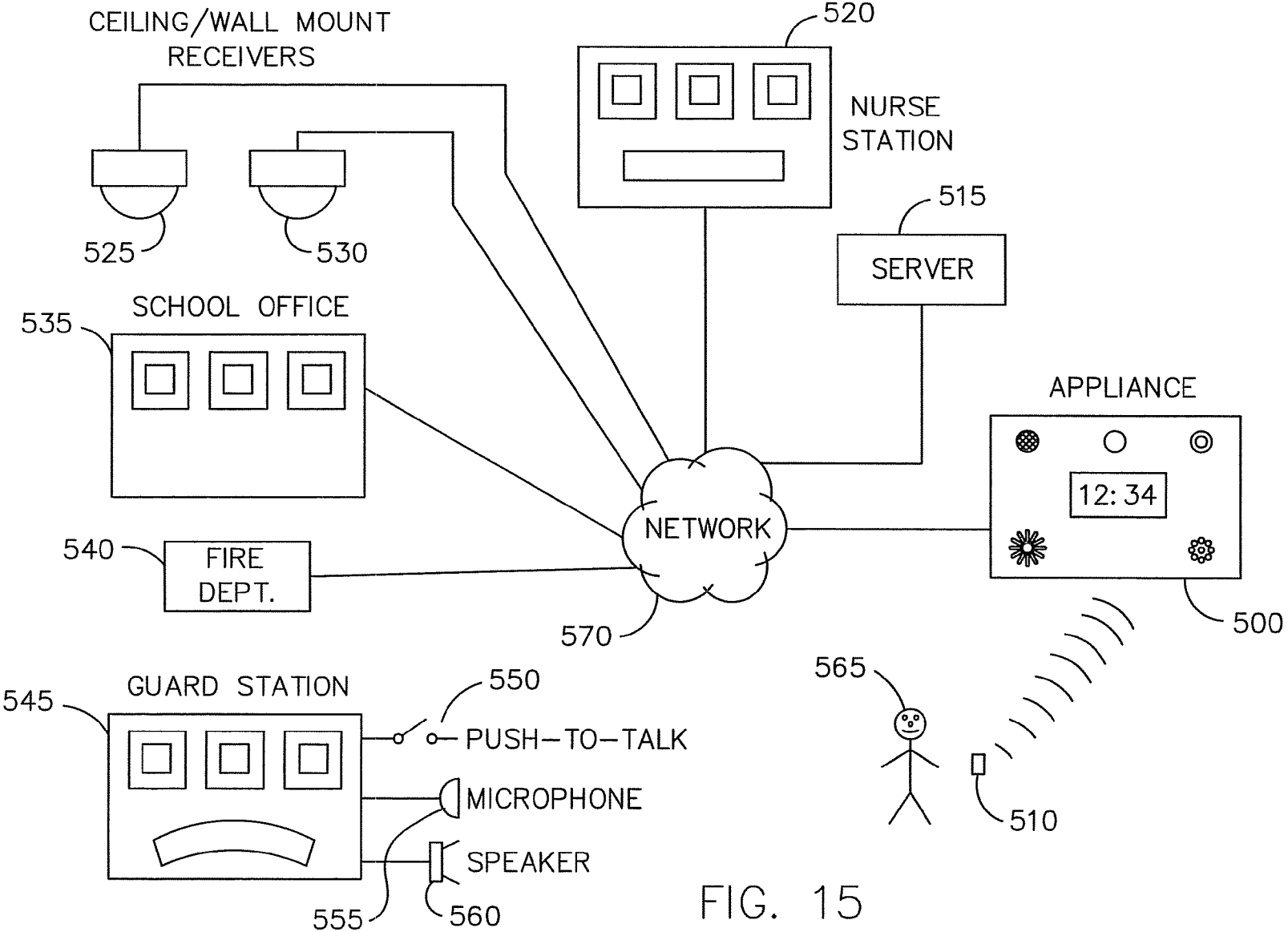
FIG. 15 illustrates a typical application of the system.

FIG. 15 depicts operation of the system. A user 565 presses a pushbutton on the personal alarm unit 510. The personal alarm composes and transmits the appropriate message, which is received and decoded by appliance 500.

The appliance 500 forwards the message in a manner appropriate for the type of condition or emergency, as defined by the specific pushbutton activated on the alarm unit 510. For example, if the user 5654 pressed the FIRE pushbutton, the appliance will notify the fire department 540 and the signal will identify the location of the of the person reporting the fire as well as the identity of the personal alarm unit sending the message via signals sent over the intervening network 570. The appliance additionally may enable the microphone and/or video camera housed within the appliance 500, permitting the fire department to further evaluate the nature and magnitude of the emergency.

If the user 565 pressed the MEDICAL pushbutton, the appliance 500 alerts the nurse station 520 of the location and identity of the user, again via the intervening network 570. Similarly, the office 535 may be notified and/or the guard station 545. In each case, the location and identity of the sender is transmitted to the appropriate monitoring stations. The audio and video capability of the room appliance will also permit further verification of the user and further audio with which to evaluate the extent of the emergency, which is to be handled.

In the embodiment shown the guard station 545 is equipped with several additional enhancements, including the microphone 555, the push-to-talk switch 550, and the speaker 560. When the guard station 545 receives a personal alert alarm signal, the microphone of appliance 500 may be remotely activated, permitting the guard station to monitor audio signals in the vicinity of the appliance for further evaluation of the events. The guard station personnel may also audibly communicate with personnel in the room using the push-to-talk feature and station microphone 555. The system would route the push-to-talk audio form the station microphone to one or more appliances such as 500 that are in the immediate area of the personal alert unit. Any of the messages generated by the appliance 500 may also be transmitted to a server 515 for archival and logging functions, as well as audio and commands generated by responding guard stations, fire stations, or other stations.

The various guard stations and other stations with microphones may also have "voice activated" push to-talk-which would automatically, based on voice level and/or duration criteria, generate the push-to-talk signals which would open up the microphone to be transmitted to the selected speaker(s) on various room appliances. For this invention, "push-to-talk" is defined as being either manual switch pushes such as on a microphone button or a computer mouse switch, or voice activated switching.

While certain features and embodiments of the invention have been described in detail herein, it will be readily understood that the invention includes all modifications and enhancements within the scope and spirit of the following claims.

What is claimed is:

1. A portable wireless device including an activation switch for generating a signal and a transmission system for transmitting the signal to a remote wireless receiver, the portable wireless device comprising:

An identification signal generator associated with the portable wireless device for including in the signal an identification component for uniquely identifying the portable wireless device; and A location signal generator associated with the portable wireless device for providing location information whereby a location of the uniquely identified portable wireless device can be identified by identification of a location of a wireless receiver in proximity to the portable wireless device, the wireless receiver being configured for receiving a wireless signal from the portable wireless device;

a wireless signal transmitter associated with the portable wireless device, the wireless signal transmitter being configured to provide a wireless signal for receipt by the wireless receiver, the wireless signal conveying the location signal; and a surveillance camera associated with at least one of the following:

the portable wireless device, the wireless receiver, a location of the portable wireless device, and a location of the wireless receiver, the surveillance camera being adapted to provide surveillance image data to an Ethernet network for transmission to a remote recipient.

2. The portable wireless device of claim 1, wherein the location signal generator is located in the portable wireless device.

3. The portable wireless device of claim 2, wherein the location signal generator comprises a global positioning system (GPS) signal generator.

4. The portable wireless device of claim 1, further including:

a. A wireless signal transmitter associated with the device;

b. A wireless signal receiver associated with the remote location.

5. The portable wireless device of claim 1, wherein the location signal generator is in the local wireless receiver.

6. The portable wireless device of claim 4, wherein the location signal generator comprises a global positioning system (GPS) signal generator.

7. The portable wireless device of claim 4, wherein the location signal generator comprises a programmable address store for programming the location of the local wireless receiver.

8. The portable wireless device of claim 1, wherein the transmission system and receiver are an RF transmitter and RF receiver.

9. The portable wireless device of claim 1, wherein the portable wireless device further includes a microphone for transmitting audio signals.

10. The portable wireless device of claim 1, wherein the location signal generator includes a beacon signal generator located in the vicinity of the receiver for sending beacon signal to the portable wireless device, and wherein the portable wireless device is adapted for retransmitting the beacon signal with the identification signal as a component of the generated signal for defining the location of the portable wireless device whenever a signal is generated thereby.

11. The portable wireless device of claim 1, wherein the transmission system and the receiver are an IR transmitter and receiver.

12. The portable wireless device of claim 1, wherein the transmission system and the receiver are an ultrasonic transmitter and receiver.

13. The portable wireless device of claim 1, wherein the portable wireless device includes a plurality of activation switches, each adapted for defining a specific type of emergency condition.

14. The portable wireless device of claim 12, further including a fire signal switch, a police signal switch and a medical emergency signal switch.

15. The portable wireless device of claim 9, wherein the beacon signal is generated whenever an activation switch is engaged.

16. The portable wireless device of claim 9, wherein the beacon signal is automatically generated on a periodic, repetitive basis.

17. The portable wireless device of claim 9, wherein the beacon signal is generated by an activation signal generated transmitted from the local wireless receiver to the portable wireless device.

18. The portable wireless device of claim 9, the portable wireless device further including a memory for storing the last received beacon signal.

19. The portable wireless device of claim 1, wherein the wireless receiver is housed in a wall appliance.

20. The portable wireless device of claim 19, wherein the wall appliance is an interactive network appliance.

* * * * *